US007259521B1

(12) United States Patent
Ritter

(10) Patent No.: US 7,259,521 B1
(45) Date of Patent: Aug. 21, 2007

(54) VIDEO DRIVER ARCHITECTURE FOR AMOLED DISPLAYS

(75) Inventor: David W. Ritter, San Jose, CA (US)

(73) Assignee: Micrel, Inc., San Jose, CA (US)

( * ) Notice: Subject to any disclaimer, the term of this patent is extended or adjusted under 35 U.S.C. 154(b) by 0 days.

(21) Appl. No.: 11/467,738

(22) Filed: Aug. 28, 2006

(51) Int. Cl.
*G09G 3/10* (2006.01)

(52) U.S. Cl. ..... 315/169.1; 315/169.3; 345/82; 345/84; 345/214; 327/108; 327/246; 327/355

(58) Field of Classification Search ..... 315/169.1, 315/169.2, 169.3; 345/82, 84, 98, 211, 212, 345/214; 327/100, 108, 127, 137, 245–248, 327/355, 359, 358, 361; 326/82, 83, 86; 341/144
See application file for complete search history.

(56) References Cited

U.S. PATENT DOCUMENTS 6,858,989 B2 * 2/2005 Howard ..... 315/169.1
6,999,015 B2 * 2/2006 Zhang et al. ..... 341/144
7,005,916 B2 * 2/2006 Nakahira et al. ..... 330/9
7,038,392 B2 * 5/2006 Libsch et al. ..... 315/169.3
7,167,169 B2 * 1/2007 Libsch et al. ..... 345/211
2005/0285822 A1 * 12/2005 Reddy et al. ..... 345/76

OTHER PUBLICATIONS

"Design of current programmed amorphous silicon AMOLED pixel circuit," B. Mazhari and Yogesh S. Chauhan, 8th Asian Symposium on information display, Nanjing, China, 2004, pp. 327-330.
Yenchung Lin et al., "A Novel Current Memory Circuit for Active Matrix Organic Light Emitting Display," SID 03 Digest, 2003, 4 pages.

* cited by examiner

*Primary Examiner*—Haissa Philogene
(74) *Attorney, Agent, or Firm*—Patent Law Group LLP; Carmen C. Cook

(57) ABSTRACT

An AMOLED display system, including an AMOLED display panel receiving a video signal, includes a video driver receiving the video signal and generating a video drive signal indicative of the video signal and referenced to a positive power supply voltage of the display panel, and a current driver coupled to an OLED pixel element receiving the video drive signal and the positive power supply voltage and providing a drive current to the OLED pixel element. The drive current is proportional to a current drive voltage which is indicative of the video signal and independent of the positive power supply voltage. In one embodiment, the video drive signal is indicative of the sum of or the difference between the positive power supply voltage and the video signal and the current drive voltage is indicative of the difference between the positive power supply voltage and the video drive signal.

8 Claims, 3 Drawing Sheets

VIDEO DRIVER ARCHITECTURE FOR AMOLED DISPLAYS

FIELD OF THE INVENTION

The invention relates to video driver for AMOLED displays and, in particular, to a video driver for AMOLED displays that is capable of isolating the pixel circuit from power supply voltage variations.

DESCRIPTION OF THE RELATED ART

Active matrix organic light emitting diode (AMOLED) displays are an emerging flat panel display technology. An AMOLED display panel contains many thousands of individual pixel drivers which provide current to energize the individual pixel OLEDs. These pixel drivers are programmed by a single current driver via a series of row and column decoders and switches such that, at any instant, only one pixel is connected to the current driver. The input to the current driver is the video drive signal.

The current provided by the current driver is proportional to the difference between the voltage level of the video drive signal and the positive power supply voltage of the display panel. Therefore, any variations in the power supply voltage will modulate the brightness of the AMOLED display. Power supply voltage variations that occur while a pixel is being programmed will be stored for an entire video frame. Since the power supply voltage variations are likely to be nonsynchronous with the video scan rate, the net result is flickers that can be observed on the display panel and are objectionable to the viewer. The direct relationship between the drive current and the power supply voltage renders AMOLED displays extremely sensitive to power supply voltage noise. It also makes the AMOLED display's overall brightness extremely dependent on the absolute voltage of the power supply voltage. Thus, the brightness level of an AMOLED display will tend to drift with power supply voltage variations. Both of these effects are undesirable.

There are many sources of power supply voltage variations that can cause flickering in AMOLED displays. In particular, when the AMOLED display is incorporated in a battery powered application, the power supply voltage will inevitably fluctuate whenever circuitry in the application device is powered up from being in a standby mode. For example, the AMOLED display may be incorporated in a cellular telephone where the battery voltage is coupled to a voltage regulator to provide the power supply voltage for the AMOLED display system. The power supply voltage will fluctuate when the transmitter or receiver circuit is powered up. Furthermore, battery voltage tends to drift over time. Even for AC powered devices, the AC power often has noise and glitches. Sensitivity to these power supply voltage transients in AMOLED displays results in poor display quality.

FIG. 1 is a schematic diagram of an exemplary AMOLED display system. In an AMOLED display system 10, a video source 12 provides a source of video signals to an AMOLED display panel 30 to be displayed. Video source 12 can be any systems that generate video signals to be displayed, such as an image processor. In most systems, the video signals are digital in nature and the final processing step of video source 12 is to convert the digital video signals to analog signals, thereby generating the analog signal Video.DAC on an output bus 18. The analog video signal Video.DAC is summed with a DC voltage $V_{DC}$ (node 14) at a summer 20 to generate the video drive signal v(t) for driving the AMOLED display panel. In the conventional AMOLED display system, the video drive signal v(t) is a signal that is referenced to the ground voltage (node 16) and has a voltage value given as:

$$v(t)=\text{Video}.DAC+V_{DC}, \qquad \text{Eq. (1)}$$

where the DC voltage $V_{DC}$ is related to the power supply voltage $V_{DD}$ of the AMOLED display system. The DC voltage $V_{DC}$ is added to the analog signal Video.DAC to bring the DC range of the analog video signal to within the range of the AMOLED display panel. Basically, the analog signal Video.DAC is referenced to ground and the $V_{DC}$ voltage level is added to offset the video signal to the power supply voltage VDD.

At the AMOLED display panel 30, the video drive signal v(t) is coupled to drive a current driver 34 for providing a drive current $I_D$ to an OLED 32. OLED 32 in FIG. 1 represents one pixel element of the display panel. OLED 32 emits light indicative of the current level of the drive current $I_D$. In most AMOLED display panels, the current driver is implemented so that the current driver 34 is referenced to the positive power supply voltage VDD (node 24) of the display system 10. For instance, in the present illustration, current driver 34 includes a PMOS transistor M1 having it's drain terminal connected to the VDD power supply voltage (node 24) and it's gate terminal connected to receive the video drive signal v(t). The source terminal of transistor M1 is coupled to the OLED 32 to provide the drive current $I_D$. The drive current $I_D$ is a function of a voltage Video.OLED across the drain-to-gate terminals of PMOS transistor M1. Current driver voltage Video.OLED is the voltage applied to the current driver 34 and determines the value of drive current $I_D$ to be applied to the OLED pixel element of the display panel. Voltage Video.OLED is referenced to the power supply voltage VDD and is given as:

$$\text{Video}.OLED=VDD-v(t). \qquad \text{Eq. (2)}$$

The power supply voltage VDD for the display panel, whether generated by a voltage regulator from a battery voltage or provided from an AC power source, will have variations due to voltage glitches, noise or drifts. The power supply voltage VDD can be characterized as the sum of an ideal power supply voltage VDDI and drift and noise components and given as $$VDD=VDDI+V_{drift}+V_{noise}. \qquad \text{Eq. (3)}$$

The current drive voltage signal Video.OLED at the display panel can be rewritten by substituting v(t) from Equation (1) and VDD from Equation (3) into Equation (2). The DC voltage $V_{DC}$ may not suffer from the same noise and drift issue as the power supply voltage and is thus assumed to have the same voltage magnitude as the ideal voltage VDDI (i.e., $V_{DC}$=VDDI). The current driver voltage Video.OLED at the display panel is then given as:

$$\begin{aligned} Video.OLED &= VDD - v(t). \qquad \text{Eq. (4)} \\ &= VDDI + V_{drift} + V_{noise} - Video.DAC - VDDI \\ &= V_{drift} + V_{noise} - Video.DAC. \end{aligned}$$

As can be observed from Equation (4), the noise and drift components of the power supply voltage VDD appear directly in the current driver voltage signal Video.OLED which determines the drive current $I_D$ for the OLED pixel element. Thus, the variations in the voltage Video.OLED due to the power supply voltage noise and drifts result in variations of the brightness level of the display, negatively impacting the display quality of the AMOLED display panel.

SUMMARY OF THE INVENTION

According to one embodiment of the present invention, an active matrix organic light emitting diode (AMOLED) display system, including an AMOLED display panel receiving a video signal to be displayed on the AMOLED display panel where the AMOLED display panel includes a plurality of organic light emitting diode (OLED) pixel elements, includes a video driver receiving the video signal and generating a video drive signal indicative of the video signal and referenced to a positive power supply voltage of the AMOLED display panel, and a current driver coupled to at least one OLED pixel element where the current driver receives the video drive signal and the positive power supply voltage and provides a drive current to the at least one OLED pixel element. The drive current is proportional to a current drive voltage which is indicative of the video signal and independent of the positive power supply voltage.

According to another aspect of the present invention, the video drive signal is indicative of the sum of or the difference between the positive power supply voltage and the video signal and the current drive voltage is indicative of the difference between the positive power supply voltage and the video drive signal.

The present invention is better understood upon consideration of the detailed description below and the accompanying drawings.

DETAILED DESCRIPTION OF THE PREFERRED EMBODIMENTS

In accordance with the principles of the present invention, a video driver for an AMOLED display system generates a video drive signal that is referenced to the positive power supply voltage of the display panel. When the video drive signal is re-referenced to the positive power supply voltage, instead of to the ground voltage as in the conventional systems, the current driver in the AMOLED display panel will generate a drive current that is indicative of the video signal but independent of the power supply voltage. In this manner, the AMOLED display system is thus made to be immune to power supply voltage variations and provides display images that are free from undesired flickers and brightness variations. When the video driver of the present invention is incorporated in an AMOLED display panel, the display panel is no longer affected by power supply voltage fluctuations, noise or glitches. The video driver of the present invention eliminates the need for a highly accurate and noise free power supply voltage for use with an AMOLED display.

Figure 1:
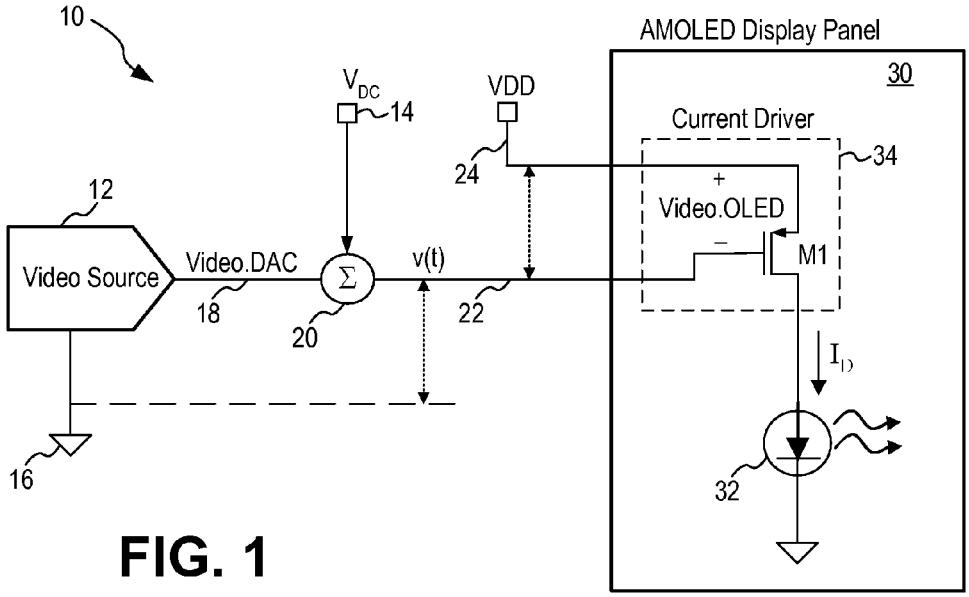
FIG. 1 (Prior Art)
FIG. 1 is a schematic diagram of a conventional AMOLED display system.
Figure 2:
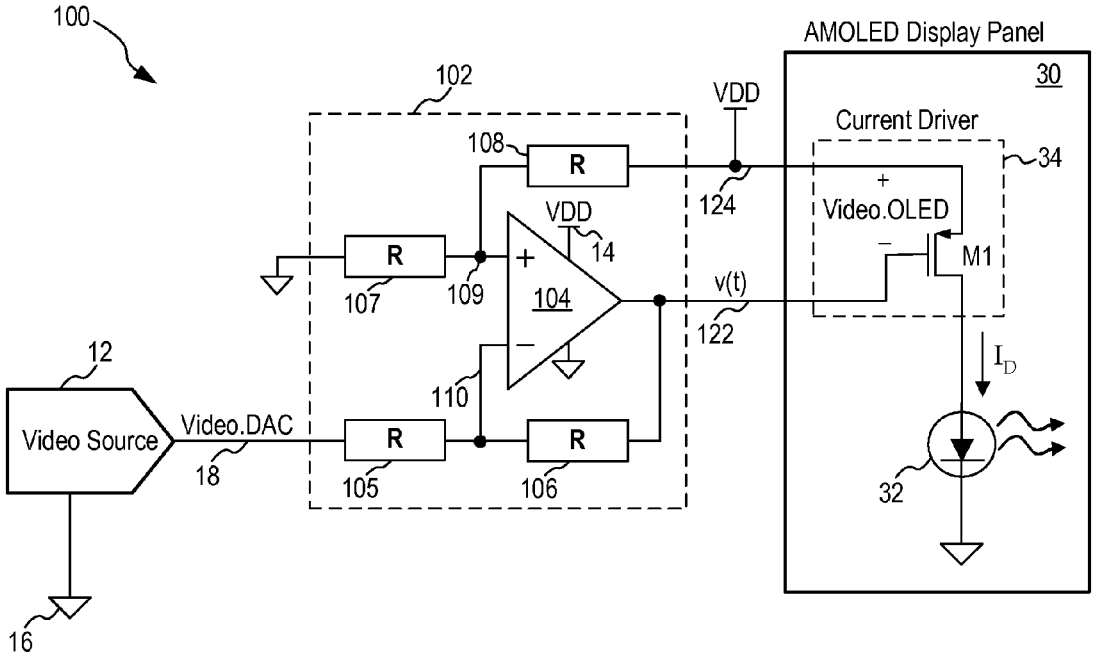
FIG. 2 is a schematic diagram of a video driver for an AMOLED display system according to a first embodiment of the present invention.

FIG. 2 is a schematic diagram of a video driver for an AMOLED display system according to a first embodiment of the present invention. Referring to FIG. 2, a video driver 102 is incorporated in an AMOLED display system 100 for receiving input video signals Video.DAC from a video source 12 and providing a modified video drive signal v(t) for driving the current driver 34 in the AMOLED display panel 30. In the present illustration, video source 12 and AMOLED display panel 30 are implemented in the same manner as in FIG. 1 above. That is, video source 12, such as an image processor, provides a source of analog video signals Video.DAC on a bus 18 to be displayed on AMOLED display panel 30. The current driver 34 in AMOLED display panel 30 receives the video drive signal v(t) (node 122) from the video driver 102 and the power supply voltage VDD (node 124) and generates a drive current $I_D$ as a function of the current driver voltage signal Video.OLED. OLED pixel element 32 emits light in response to the drive current $I_D$.

The video source 12 and the AMOLED display panel 30 in AMOLED display system 100 are exemplary and their exact implementations are not critical to the practice of the present invention. Video driver 102 of the present invention can be incorporated in any AMOLED display systems to facilitate the generation of the video drive signals for an AMOLED display panel.

In the present embodiment, video driver 102 is implemented using a differential instrumentation amplifier circuit to re-reference the video drive signal v(t) to the positive power supply voltage VDD. More specifically, video driver 102 includes an operational amplifier (opamp) 104 having a positive input terminal 109, a negative input terminal 110 and an output terminal (node 122) providing the video drive signal v(t). The positive input terminal 109 of opamp 104 is coupled to a resistor 107 where the other terminal of resistor 107 is connected to the ground voltage. A resistor 108 is coupled between the positive input terminal 109 of opamp 104 and the power supply voltage VDD (node 124) of the AMOLED display system 100. The negative input terminal 110 of opamp 104 is coupled to a resistor 105 where the other terminal of resistor 105 is connect to bus 18 for receiving the video signal Video.DAC. A resistor 106 is connected between the negative input terminal 110 and the output node 122 of opamp 104 to form the feedback loop in the instrumentation amplifier circuit.

In a conventional differential instrumentation amplifier circuit, the positive input terminal of the opamp would be connected through resistor 108 to the ground voltage. However, in accordance with the present invention, the positive input terminal 109 of opamp 104 is connected through resistor 108 to the power supply voltage VDD instead of the ground voltage so as to realize the re-referencing function of video driver 102. By connecting the positive input terminal 109 to the power supply voltage VDD, when the power supply voltage varies, the output signal of the instrumentation amplifier circuit, that is, the video drive signal v(t) on node 122, will vary in such a way as to track the power supply voltage variations. As a result, the video drive signal v(t) becomes the difference between the video signal Video.DAC and the power supply voltage VDD and given as:

$$v(t)=VDD-\text{Video}.DAC. \quad \text{Eq. (5)}$$

Instead of being referenced to the ground voltage, the video drive signal v(t) is now made to be referenced to the power supply voltage VDD.

Then, when the video drive signal v(t) is applied to the current driver 34 for the OLED pixel element 32, the current drive voltage signal Video.OLED at the current driver 34 is given as:

$$\begin{aligned} Video.OLED &= VDD - v(t); \quad \text{Eq. (6)} \\ &= VDD - VDD + Video.DAC \\ &= Video.DAC. \end{aligned}$$

As can be observed from Equation (6), the current drive voltage signal Video.OLED is made to be independent of the power supply voltage VDD. Thus, any noise or DC drifts in the power supply voltage VDD (node 124) will not disturb the current drive signal Video.OLED and will not affect the brightness of the AMOLED display.

Thus, by using the video driver of the present invention to re-reference the video drive signal v(t) so that it is referenced from the power supply voltage VDD, the AMOLED display panel 30 is made immune to noise and drifts in the power supply voltage and the display quality can improve without requiring the use of a high precision power supply voltage.

In the video driver 102, resistors 105 to 108 can have the same or different resistance values. When the resistance values of resistors 105 to 108 are the same, the differential instrumentation amplifier has unity gain. If some gain or attenuation is desired, then different resistance values for resistors 105 to 108 can be used, as is understood by one of ordinary skill in the art.

Figure 3:
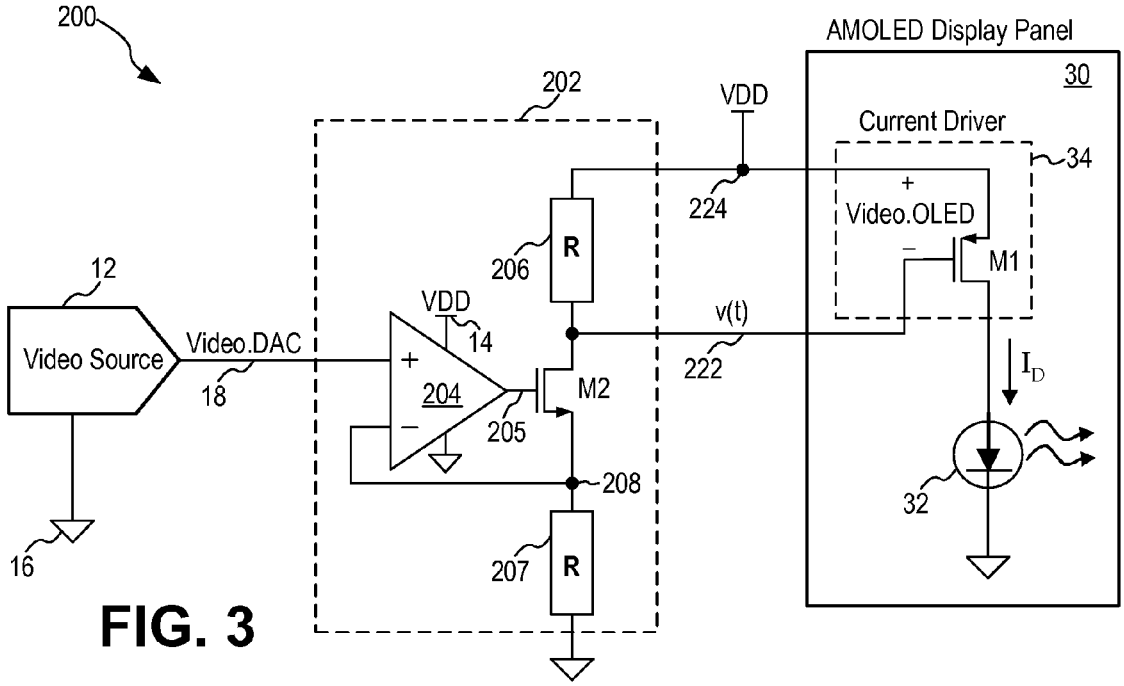
FIG. 3 is a schematic diagram of a video driver for an AMOLED display system according to a second embodiment of the present invention.

FIG. 3 is a schematic diagram of a video driver for an AMOLED display system according to a second embodiment of the present invention. Referring to FIG. 3, a video driver 202 is incorporated in an AMOLED display system 200 for receiving input video signals Video.DAC from a video source 12 and providing a modified video drive signal v(t) for driving the current driver 34 in the AMOLED display panel 30, in the same manner as video driver 102 in FIG. 2. In the present embodiment, video driver 202 is implemented as a current mode isolator circuit. Video driver 202 includes an opamp 204 having a positive input terminal receiving the video signal Video.DAC and a negative input terminal connected in a feedback configuration. The output terminal 205 of opamp 204 is coupled to drive an NMOS transistor M2. A resistor 206 is connected between the power supply voltage VDD (node 224) and the source terminal (node 222) of transistor M2, which also provides the video drive signal v(t). A resistor 207 is connected between the drain terminal (node 208) of transistor M2 and the ground voltage. The negative input terminal of opamp 204 is also connected to the drain terminal (node 208) of transistor M2) to from the feedback loop.

The combination of opamp 204 and transistor M2 forms a transconductance amplifier where the voltage of the video signal Video.DAC is converted to a current at transistor M2 and load resistor 207. The current that passes through transistor M2 is put through resistor 206 which is referenced to the power supply voltage VDD. In this manner, the current is converted to the voltage signal v(t) at node 222 which is referenced to the power supply voltage VDD through the resistive load of resistor 206. By using video driver 202 incorporating a current mode isolator, the video drive signal v(t) is made referenced to the power supply voltage VDD so that the current drive voltage signal Video.OLED is made independent of the power supply voltage VDD. Variations in the power supply voltage VDD will no longer adversely affect the AMOLED display.

In video driver 202, the video drive signal v(t) is given as follows:

$$\begin{aligned} v(t) &= VDD - (Video.DAC/R) * R; \quad \text{Eq. (7)} \\ &= VDD - Video.DAC. \end{aligned}$$

Instead of being referenced to the ground voltage, the video drive signal v(t) is now made to be referenced to the power supply voltage VDD.

Then, in the same manner as Equation (6) above, when the video drive signal v(t) is applied to the current driver 34 for the OLED pixel element 32, the current drive voltage signal Video.OLED at the current driver 34 becomes:

$$\begin{aligned} Video.OLED &= VDD - v(t); \\ &= VDD - VDD + Video.DAC \\ &= Video.DAC. \end{aligned}$$

Thus, the current drive voltage signal Video.OLED is made to be independent of the power supply voltage VDD. Any noise or DC drifts in the power supply voltage VDD (node 224) will not disturb the current drive signal Video.OLED and will not affect the brightness of the AMOLED display.

In the video driver 202, resistors 206 and 207 can have the same or different resistance values. When the resistance values of resistors 206 and 207 are the same, the current mode isolator circuit has unity gain. If some gain or attenuation is desired, then different resistance values for resistors 206 and 207 can be used, as is understood by one of ordinary skill in the art.

Figure 4:
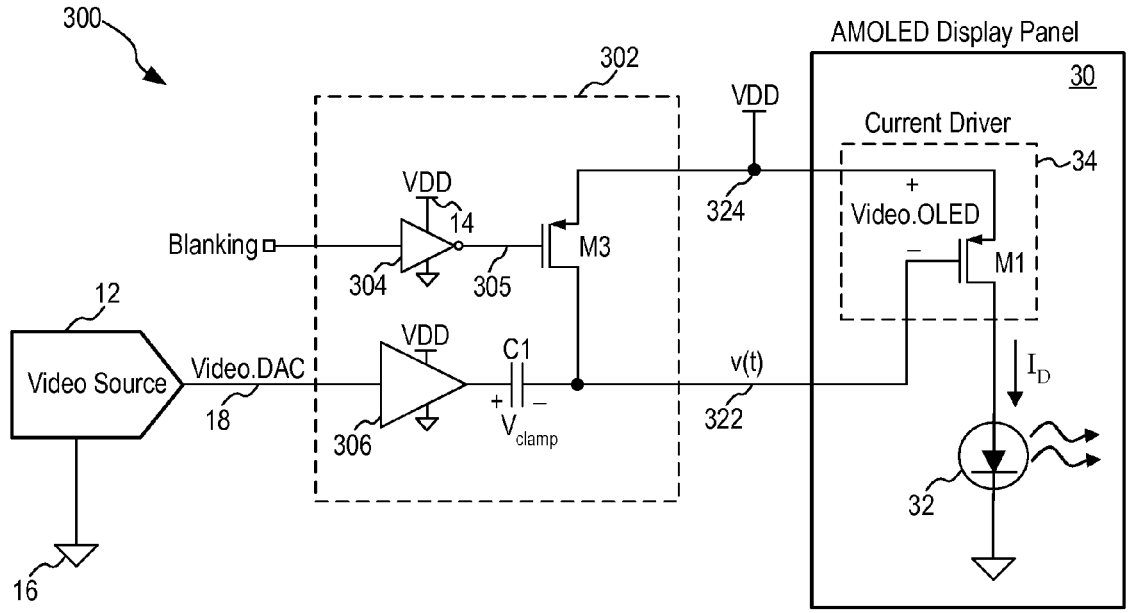
FIG. 4 is a schematic diagram of a video driver for an AMOLED display system according to a third embodiment of the present invention.

FIG. 4 is a schematic diagram of a video driver for an AMOLED display system according to a third embodiment of the present invention. In the embodiment shown in FIG. 4, a video drive 302 is implemented using a video clamp circuit to reference the video drive signal to the power supply voltage VDD. In video driver 302, the video clamp circuit is implemented using an amplifier 306 coupled to receive the video signal Video.DAC and driving one plate of a capacitor C1. The other plate (node 322) of capacitor C1 is the video drive signal v(t). Video driver 302 also includes an inverter 304 receiving the video blanking signal and driving a PMOS transistor M3. PMOS transistor M3 has a source terminal connected to the power supply VDD voltage (node 324) and a drain terminal connected to the left plate (node 322) of capacitor C1 providing the video drive signal v(t).

As thus configured, when the Blanking signal is asserted at the beginning of each video line to re-establish the black reference of the video display, transistor M3 is turned on and the right plate of capacitor C1 is charged up to the power supply voltage VDD. In this manner, the power supply voltage VDD, including any voltage drifts, is stored on capacitor C1 as the clamping voltage $V_{clamp}$. When the Blanking signal is deasserted, transistor M3 is turned off and no longer drives node 322. Instead, the video signal Video-.DAC is applied through amplifier 306 and is added to the clamping voltage $V_{clamp}$ stored on capacitor C1. In this manner, the clamping voltage $V_{clamp}$ is added to the video signal Video.DAC for the rest of the video line and the video drive signal v(t) is now referenced to the power supply voltage VDD.

More specifically, video driver 302 is effective in removing voltage drifts in the power supply voltage but does not necessarily remove noise or glitches in the power supply voltage from impacting the video drive signal. This is because the clamping voltage $V_{clamp}$ is recharged only once for each video line and thus any noise or voltage glitches that may appear on the power supply voltage VDD will not get charged to capacitor C1 until the next Blanking period. However, making the AMOLED display panel immune to voltage drifts is important as voltage drifts in the power supply voltage VDD tend to cause the display panel to become brighter and brighter.

Again, assume that the power supply voltage VDD is the sum of an ideal power supply voltage VDC and noise and voltage drift. The clamping voltage $V_{clamp}$ is given as:

$$V_{clamp}=VDD=VDC+\text{Vdrift}. \qquad \text{Eq. (8)}$$

Note that the noise component is not present in the clamping voltage because the capacitor C1 is only recharged once every horizontal line. The video drive signal v(t) is given as:

$$\begin{aligned} v(t) &= V_{clamp} + Video.DAC; \\ &= VDC + Vdrift + Video.DAC. \end{aligned}$$

The current drive voltage signal Video.OLED is given as:

$$\begin{aligned} Video.OLED &= VDD - v(t); \qquad \text{Eq. (9)} \\ &= VDC + Vdrift + Vnoise - \\ &\quad VDC - Vdrift - Video.DAC; \\ &= Vnoise - Video.DAC. \end{aligned}$$

As can be observed from equation (9), when the video driver 302 is implemented using a video clamp circuit, voltage drifts in the power supply voltage VDD are removed from the current drive signal Video.OLED but noise in the power supply voltage may remain to impact the current drive voltage Video.OLED.

The video driver circuit of the present invention described above with reference to FIGS. 2-4 can be implemented using discrete components. Alternately, the video driver circuit of the present invention can be implemented as an integrated circuit to be incorporated in the AMOLED display system. Furthermore, the video driver circuit of the present invention can be integrated with other circuitry of the AMOLED display panel into a single integrate circuit. For instance, the video driver of the present invention can be integrated on the same integrated circuit with the current driver and the OLED pixel elements of the AMOLED display panel. In FIGS. 2-4, the video drivers are shown as being formed outside of the AMOLED display panel 30. The embodiments in FIGS. 2-4 are illustrative only and are not intended to require the video driver to be formed outside of the AMOLED display panel. The video driver of the present invention can be integrated with the AMOLED display panel when desired to reduce the component count and size of the PC board space used.

Figure 5:
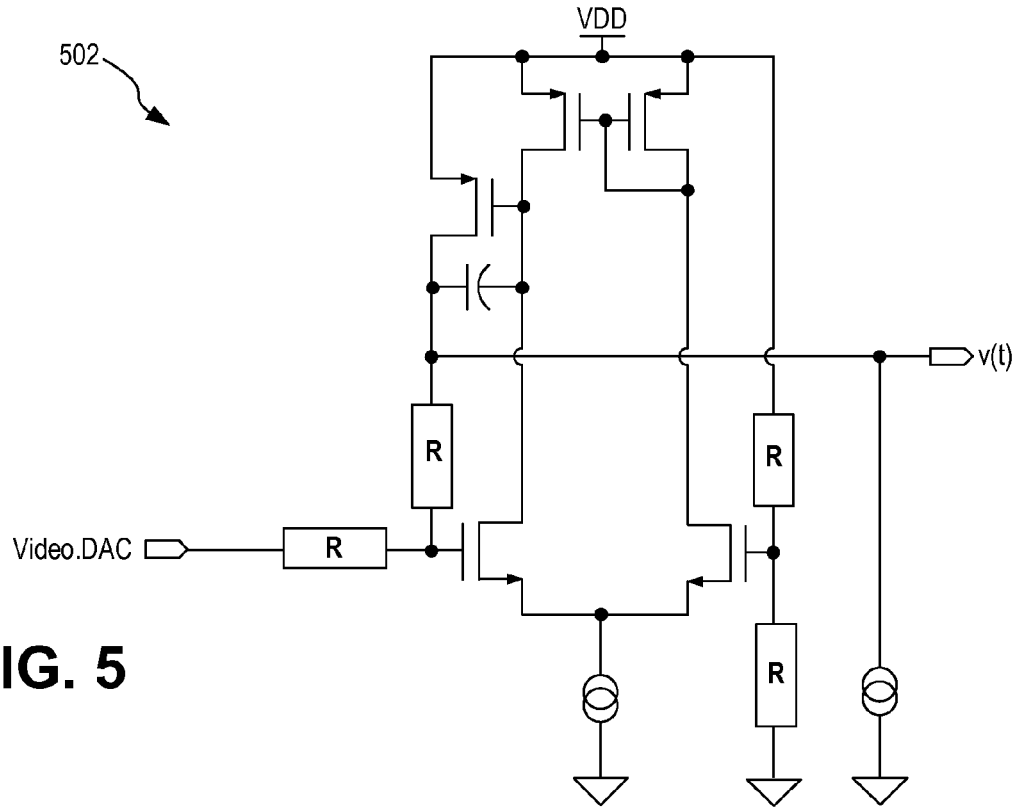
FIG. 5 is a transistor level circuit diagram for implementing the video driver of FIG. 2.
Figure 6:
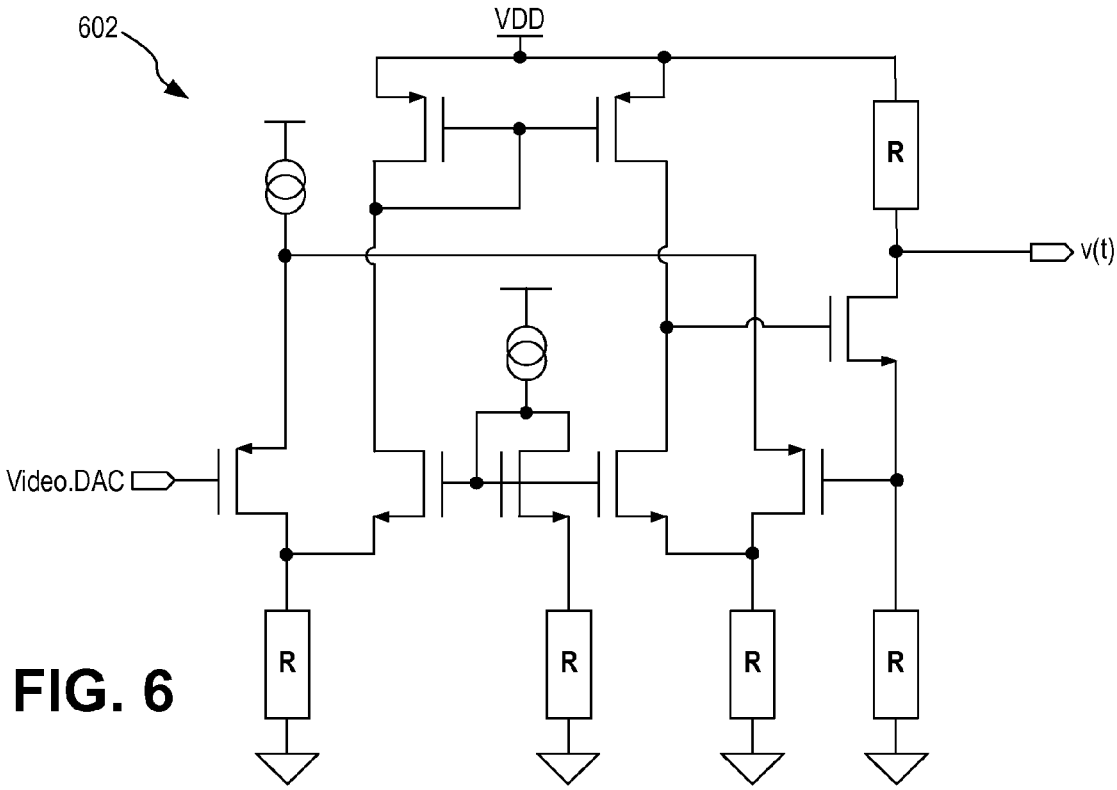
FIG. 6 is a transistor level circuit diagram for implementing the video driver of FIG. 3.

FIG. 5 is a transistor level circuit diagram for implementing the video driver of FIG. 2. FIG. 5 illustrates an exemplary implementation of a differential instrumentation amplifier circuit as the video driver in an integrated circuit. FIG. 6 is a transistor level circuit diagram for implementing the video driver of FIG. 3. FIG. 6 illustrates an exemplary implementation of a current mode isolator circuit as the video driver in an integrated circuit. FIGS. 5 and 6 are provided as examples to illustrate the integrated circuit implementation of the video driver of the present invention. FIGS. 5 and 6 are illustrative only and are not intended to be limiting.

The above description provides several embodiments of the video driver of the present invention that can be used in an AMOLED display system to re-reference the video drive signal for the current driver of the OLED pixel elements to the positive power supply voltage. The above-described embodiments are illustrative only and are not intended to be limiting. One of ordinary skill in the art, upon being appraised of the present description, would appreciate that other video driver circuitry can be used to re-reference the video drive signal for the current driver of the OLED pixel elements in the AMOLED display panel.

By using the video driver of the present invention to re-reference the video drive signal to the power supply voltage, an AMOLED display panel can operate with power supply voltage that may not be highly accurate or highly precise. The video driver of the present invention provides a low cost solution to the power supply sensitivity of the AMOLED display panel. The simplicity and low cost advantage of the video driver of the present invention cannot be obtained by conventional solutions.

The above detailed descriptions are provided to illustrate specific embodiments of the present invention and are not intended to be limiting. Numerous modifications and variations within the scope of the present invention are possible. For instance, the ground voltage can be any ground reference voltage, including a negative power supply voltage. Furthermore, the resistance values of the resistors shown in FIGS. 2-6 can be the same or they can be different depending on the desired gain or attenuation for the video driver circuit. The present invention is defined by the appended claims.

I claim:

1. An active matrix organic light emitting diode (AMOLED) display system comprising an AMOLED display panel receiving a video signal to be displayed on the AMOLED display panel, the AMOLED display panel comprising a plurality of organic light emitting diode (OLED) pixel elements, the AMOLED display system comprising:

a video driver receiving the video signal and generating a video drive signal indicative of the video signal and referenced to a positive power supply voltage of the AMOLED display panel; and a current driver coupled to at least one OLED pixel element, the current driver receiving the video drive signal and the positive power supply voltage and providing a drive current to the at least one OLED pixel element, the drive current being proportional to a current drive voltage being indicative of the video signal and independent of the positive power supply voltage.

2. The AMOLED display system of claim 1, wherein the video drive signal is indicative of the sum of or the difference between the positive power supply voltage and the video signal and the current drive voltage is indicative of the difference between the positive power supply voltage and the video drive signal.

3. The AMOLED display system of claim 2, wherein the video driver comprises a differential instrumentation amplifier circuit for providing the video drive signal being the difference between the positive power supply voltage and the video signal.

4. The AMOLED display system of claim 3, wherein the video driver comprises:

an operational amplifier having a positive input terminal coupled to a first resistor, a negative input terminal coupled to a second resistor and an output terminal providing the video drive signal;

the first resistor being coupled between the positive input terminal of the operational amplifier and a ground voltage or a negative power supply voltage;

the second resistor being coupled between the video signal and the negative input terminal of the operational amplifier;

a third resistor being coupled between the positive input terminal of the operational amplifier and the positive power supply voltage; and a fourth resistor being coupled between the negative input terminal and the output terminal of the operational amplifier.

5. The AMOLED display system of claim 2, wherein the video driver comprises a current mode isolator circuit for providing the video drive signal being the difference between the positive power supply voltage and the video signal.

6. The AMOLED display system of claim 5, wherein the video driver comprises:

an operational amplifier having a positive input terminal coupled to receive the video signal, a negative input terminal and an output terminal;

a transistor having a first current handling terminal providing the video drive signal, a second current handling terminal coupled to the negative input terminal of the operational amplifier, and a gate terminal coupled to the output terminal of the operational amplifier;

a first resistor being coupled to the negative input terminal of the operational amplifier and a ground voltage or a negative power supply voltage; and a second resistor being coupled to the first current handling terminal of the transistor and the positive power supply voltage.

7. The AMOLED display system of claim 2, wherein the video driver comprises a video clamp circuit for providing the video drive signal being the sum of the positive power supply voltage and the video signal.

8. The AMOLED display system of claim 7, wherein the video driver comprises:

a first inverter having an input terminal coupled to receive a video blanking signal and an output terminal;

a first transistor having a first current handling terminal coupled to the positive power supply voltage, a second current handling terminal coupled to a first node providing the video drive signal, and a gate terminal coupled to the output terminal of the first inverter, the first transistor being turned on when the video blanking signal is asserted and turned off when the video blanking signal is deasserted;

an amplifier having an input terminal coupled to receive the video signal and an output terminal; and a capacitor coupled between the output terminal of the amplifier and the first node, wherein the capacitor is charged to the positive power supply when the video blanking signal is asserted and is charged to a sum of the video signal and the positive power supply voltage when the video blanking signal is deasserted.

* * * * *